US005203620A

United States Patent [19]

McLennan

[11] Patent Number: 5,203,620

[45] Date of Patent: Apr. 20, 1993

[54] DRAWER GUIDE AND LATCH COMBINATION

[76] Inventor: Bruce H. McLennan, 933 Hawthorne Dr. NE., Lenoir, N.C. 28645

[21] Appl. No.: 857,480

[22] Filed: Mar. 25, 1992

Related U.S. Application Data

[63] Continuation-in-part of Ser. No. 737,781, Jul. 30, 1991, abandoned.

[51] Int. Cl.[5] ..... A47B 88/00

[52] U.S. Cl. ..... 312/334.46; 312/334.47

[58] Field of Search ..... 312/334.46, 334.47, 312/348.1, 333, 330.1, 334.44

[56] References Cited

U.S. PATENT DOCUMENTS

| | | | |
|---|---|---|---|
| 1,557,765 | 10/1925 | Nicholas | 312/334.47 |
| 2,765,208 | 10/1956 | Bush | 312/334.46 |
| 3,259,447 | 7/1966 | Deutsch | 312/334.46 |
| 3,397,001 | 8/1968 | Friedman | 312/334.46 |
| 4,423,914 | 1/1984 | Vanderley | 312/334.47 |
| 4,441,772 | 4/1984 | Fielding et al. | 312/334.47 |
| 4,549,773 | 10/1985 | Papp et al. | 312/334.47 |
| 4,805,970 | 2/1989 | Scalf | 312/334.47 |

FOREIGN PATENT DOCUMENTS

| | | | |
|---|---|---|---|
| 1174453 | 3/1959 | France | 312/334.47 |

*Primary Examiner*—Victor N. Sakran

[57] ABSTRACT

A pivotal drawer guide latch is affixed to a central bottom cabinet drawer guide of a cabinet drawer to prevent inadvertent removal of the drawer from the cabinet. A spring maintains the latch in a normal downward position to allow the latch to catch the front cabinet rail as the drawer is opened. To remove the drawer from the cabinet, the latch is depressed thereby allowing the drawer to be totally removed from the cabinet. A biased face on the latch allows the catch to slide over the front rail as the drawer is reinserted into the cabinet.

15 Claims, 3 Drawing Sheets

DRAWER GUIDE AND LATCH COMBINATION

This is a continuation-in-part application of pending U.S. patent application Ser. No. 07/737,781 filed Jul. 30, 1991, now abandoned.

BACKGROUND OF THE INVENTION

1. Field Of The Invention

The invention herein pertains to furniture and cabinet drawers and particularly to drawers employing wooden guides with a stop mechanism to limit the outward drawer movement.

2. Description Of The Prior Art And Objectives Of The Invention

Various drawer stops have been utilized in the past to prevent drawers which are slidably mounted within cases or cabinets to prevent inadvertent removal and spillage of the contents. For example, chest of drawers, kitchen cabinets and the like in recent years have employed metal and wooden guide rails of various configurations in an effort to increase the smoothness of the drawer action as it moves in and out of the cabinet. Conventional stops used in conjunction with the guides have not proven entirely satisfactory since the drawers cannot usually be easily released from the cabinet when necessary without undue effort and apprehension by the user. Therefore, it is an objective of the present invention to provide a drawer guide and latch combination which can be used in conjunction with conventional drawer guides which will not add a great deal of cost to the product.

It is still another objective of the present invention to provide a drawer guide and latch combination whereby a latch is pivotally affixed to the wooden female section of a central bottom drawer guide which will catch the front rail of the cabinet, thereby preventing accidental drawer removal from the cabinet.

It is another objective of the present invention to provide a drawer latch which is spring loaded and which can be released in the event the user desires to remove the drawer from the cabinet.

It is also an objective of the present invention to provide a drawer latch which allows the drawer to be easily reinserted into the cabinet after removal therefrom.

The aforesaid and other objectives and advantages of the present invention will be more fully realized as a more detailed description of the invention is presented below.

SUMMARY OF THE INVENTION

The invention herein provides a drawer latch which is affixed to a conventional wooden drawer guide having male and female sections whereby the latch will prevent the drawer from being inadvertently pulled totally from the cabinet, such as may occur if the drawer is jerked open. The latch is affixed to a centrally positioned drawer guide beneath the drawer and includes a pivotable pawl which will catch the front rail of the drawer opening in the cabinet when the drawer is opened and substantially extended therefrom. The pawl includes an accessible finger rest which can be used to depress the pawl to release the catch and allow the drawer to be fully removed when desired. The pawl is pivotally mounted to the drawer guide by an axle pin which is positioned in the female member of the drawer guide for the pawl to rotate therearound. A spring maintains the pawl catch in a downward "ready" position to enable the pawl to catch the front rail if the drawer is pulled forward as during opening. The front rail may include a rear projection which the pawl catch will intercept. The pawl can be released from the front rail for removal of the drawer from the cabinet by depressing the finger rest and thereafter, when the finger rest is released, the pawl returns to its downward position. To reinsert the drawer into the cabinet, the male and female guide sections are aligned and the drawer is then urged into the cabinet. A biased rear face on the pawl catch allows the pawl to ride up and over the front rail after which it returns to its downward position to prevent inadvertent drawer removal.

DESCRIPTION OF THE PREFERRED EMBODIMENT

Figure 2:
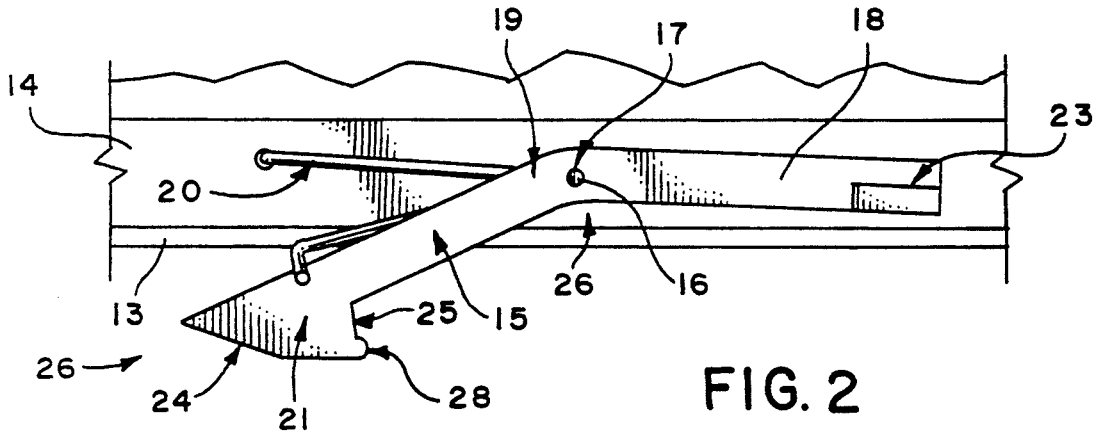
FIG. 2 illustrates the drawer guide and latch combination.
Figure 3:
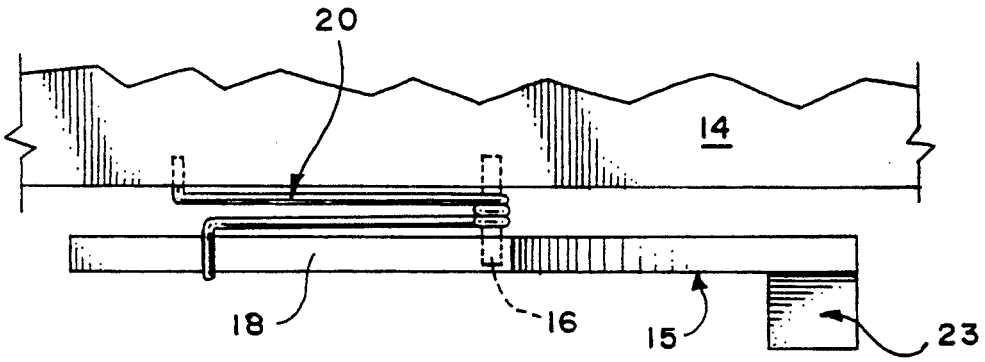
FIG. 3 demonstrates a top view of the drawer guide and latch combination of FIG. 2.

The preferred form of the invention is shown in FIGS. 2 and 3 whereby a latch is pivotally affixed to the female section of a central bottom drawer guide. The latch consists of an elongated pawl having a somewhat inverted v-shape and includes a depending catch having a substantially "square" front face and a biased rear face at the rear or left side of the pawl as shown in FIG. 2. On the front end of the pawl is a lateral finger rest as shown more clearly in FIG. 3. A spring is joined to the pawl and the guide member which maintains the pawl in a downward position to enable the pawl to catch the front drawer rail as the drawer is pulled outwardly from the cabinet. If the drawer is removed from the cabinet, the biased rear face of the pawl catch allows the drawer to be easily reinserted into the cabinet since the biased face will allow the pawl to slide up and over the front rail during reinsertion. The inverted somewhat v-shape allows the user to slide his fingers under the bottom of the drawer as for example with the drawer as seen in FIG. 4, and to depress the pawl, thereby freeing the drawer for removal.

DETAILED DESCRIPTION OF THE DRAWINGS AND OPERATION OF THE INVENTION

Figure 1:
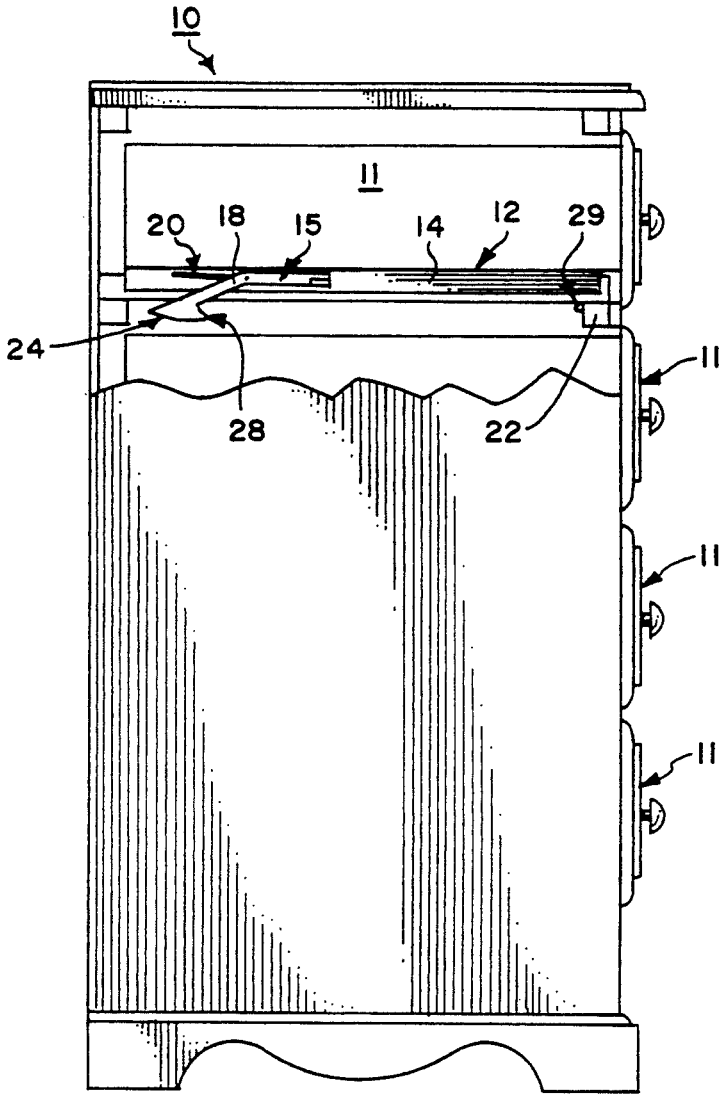
FIG. 1 demonstrates a chest of drawers with the invention with the cabinet shown somewhat cut-away.

For a better understanding of the invention and its operation, turning now to the drawings, FIG. 1 illustrates a conventional chest of drawers or cabinet 10 having a series of drawers 11 therein. Drawers 11 are each affixed to a wooden drawer guide assembly 12 with female drawer guide section 14 which in turn is slidably positioned over male drawer guide section 13. As would be understood, cabinet 10 is of conventional design as is drawer guide assembly 12. Latch 15 is joined to female drawer guide assembly 14 as shown in FIG. 2 by the use of an axle pin 16. Axle pin 16 passes through opening 17 in crotch 26 of pawl 18 which has a somewhat elongated, inverted v-shaped body 19. Spring 20 as shown in FIG. 2 comprises a means for resiliently maintaining pawl catch 21 in a downward posture. As would be understood, pawl front catch face 25 intercepts cabinet front rail 22 as illustrated in FIG. 4 to prevent total withdrawal of drawer 11. Nib 28 of catch 21 engages rear projection 29 of front rail 22 to secure catch 21. To remove drawer 11 totally from cabinet 10, laterally extending finger rest 23 is manually depressed which in turn pivots pawl 18 clockwise as seen in FIG. 4 and allows catch 21 to pass over rail 22. Upon removal of pressure from finger rest 23, pawl 18 returns to its downward posture as seen in FIG. 4 due to the force applied by resilient spring 20. As seen in FIG. 3, spring 20 comprises a conventional wire spring which is inserted in an opening at the rear of female guide section 14. Spring 20 is coiled around axle pin 16 and also attaches to the top of pawl 18.

Figure 4:
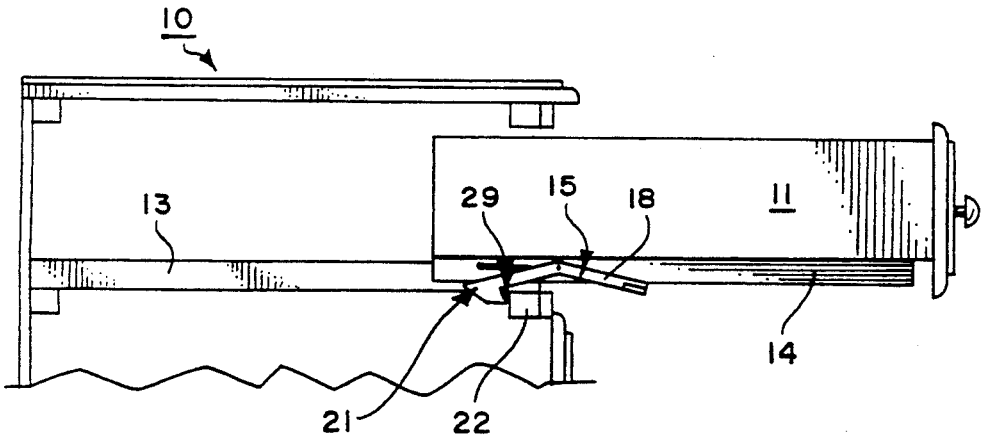
FIG. 4 shows the latch engaging the front cabinet rail with the drawer extended.

As further shown in FIGS. 2 and 4, catch 21 comprises a downwardly extending member positioned at the distal end 26 of pawl 18. Catch 21 includes an angled or biased rear face 24 as shown in FIG. 2 which forms a pointed end on pawl 18 which allows drawer 11 to be easily reinserted into cabinet 10 as biased face 24 slides up and over front rail 22. As would also be understood from FIG. 2, the user's fingers can easily reach under the bottom of drawer 11 (not shown in FIG. 2) due to the inverted "v" shape of pawl 18.

Figure 5:
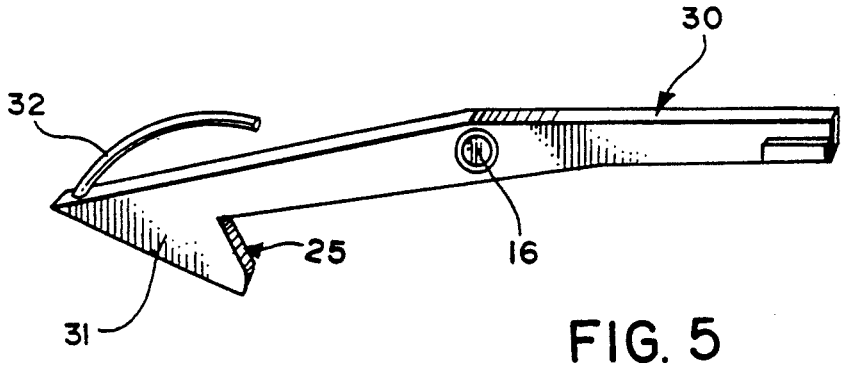
FIG. 5 shows a second embodiment of a latch.

A second embodiment of the latch of the invention is presented in FIG. 5 whereby latch 30 which may be molded from a synthetic polymer includes catch 31 with a resilient curved finger-like projection 32 joined to the top thereof. In use, projection 32 maintains catch 31 in a downward position as projection 32 contacts the bottom of drawer 11 (not seen in FIG. 5). Projection 32 acts as a spring and will bend or compress to accommodate drawer insertion into a cabinet or the like.

Figure 6:
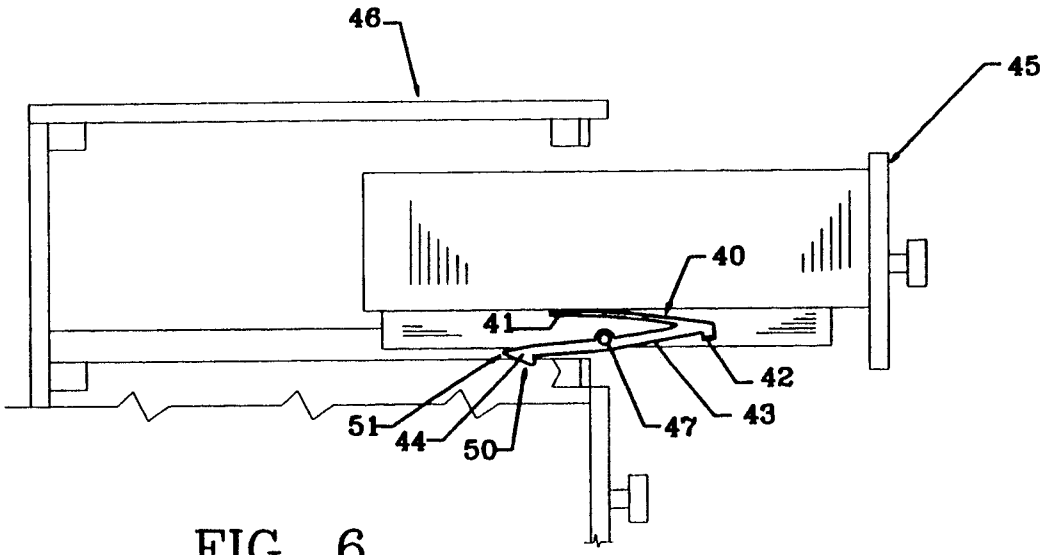
FIG. 6 illustrates yet another embodiment of a latch.

Yet another embodiment of the latch is shown in FIG. 6 whereby latch 40 as shown therein is mounted on drawer 45 and includes a longer, slightly curved resilient, finger-like projection 41 which is attached to finger rest 42 positioned on pawl 43. Catch 44 as hereinbefore described includes a biased rear face 50 to create a point 51 for ease and convenience in reinserting drawer 45 when removed. Latch 40 like latch 30 is made from a durable synthetic polymer and resilient projection 41 is flexible yet will maintain catch 44 in a downward position until finger pressure is applied to rest 42 (when desired to remove drawer 45 from cabinet 46). Rest 42 is attached to pawl 43 on the bottom thereof. Finger-like projection 41 extends upwardly over pawl 43 beyond axle 47 at an angle of approximately thirty-five degrees. Pawl 43 may for example have a width of one-quarter inch whereas finger-like projection 41 may have a width of only one-eighth of an inch and a height or thickness of one-sixteenth of an inch to provide the desired flexibility required. Projection 41 resiliently urges pawl 43 downwardly as hereinbefore explained until it is desired to remove drawer 45.

The illustrations and examples provided herein are for explanatory purposes and are not intended to limit the scope of the appended claims.

I claim:

1. A drawer latch for a cabinet comprising: a pawl, said pawl having an elongated body with a front and a rear end, said body defining an axle opening therein, a catch, said catch positioned on the rear end of said pawl, a finger rest, said rest positioned on the front end of said pawl, said rest extending laterally from said pawl for application of manual pressure thereto, said catch comprising a front face and a biased rear face, a resilient member, said resilient member affixed to said elongated body, whereby said pawl will grasp the cabinet as the drawer is opened to prevent accidental complete withdrawal and after selected drawer removal by applying manual pressure to said finger rest, will allow said drawer to be easily reinserted.

2. The drawer latch of claim 1 wherein said catch comprises a nib, said nib affixed to said catch front face.

3. The drawer latch of claim 1 wherein said pawl body comprises an inverted v-shape, said body defining an axle opening.

4. The drawer latch of claim 3 wherein said axle opening is positioned at the crotch of said v-shaped body.

5. A cabinet drawer guide, cabinet rail and latch combination, the drawer guide consisting of a male section which is rigidly attached to the front rail and back of the cabinet and a female section which is attached to the bottom of a drawer, said female section for slidably receiving said male section to allow the drawer to guidably slide in and out of said cabinet, the latch having a spring attached thereto for preventing inadvertent drawer removal from the cabinet, the improvement comprising: a pivotable, elongated latch pawl, said latch having a front and a rear end, said pawl affixed to said female guide section, means to resiliently position said pawl in a downward posture, said resilient means attached to said pawl, said pawl comprising an inverted, v-shaped body, said pawl body comprising a catch at the rear end and a laterally extending finger rest at the front end, said catch comprising a biased rear face, said pawl body defining an axle opening, said opening positioned in the crotch of said v-shaped body, a pawl axle, said axle affixed to said female guide section, and said axle opening for receiving said axle for pawl rotation therearound from a downward posture to latch the drawer within the cabinet as the pawl catches the front cabinet rail, to a raised posture to allow the drawer to be removed from the cabinet as the pawl passes over the front rail upon application of manual pressure to said finger rest.

6. The combination of claim 5 wherein said pawl catch comprises a nib.

7. The combination of claim 5 wherein said cabinet front rail comprises a rear projection.

8. A cabinet drawer latch comprising: an elongated pawl, said pawl having a front and a rear end, a catch, said catch attached to said pawl, a finger-like resilient member, said resilient member attached to said catch, said resilient member extending upwardly directly over said catch for contact with the drawer to maintain said catch in a downward position as said drawer is opened.

9. A drawer latch as claimed in claim 8 wherein said resilient member comprises an arcuate projection, said projection extending over said pawl.

10. A drawer latch as claimed in claim 8 wherein said catch comprises a biased rear face.

11. A cabinet drawer latch comprising; a vertically pivotal latch pawl, said pawl comprising an elongated body, said elongated body having a front and a rear end, a catch, said catch positioned on one end of said pawl, said catch comprising a front face and a biased rear face, a finger rest, said rest positioned on the front end of said pawl, a resilient finger member, said resilient finger member attached to said body proximate said rest and extending angularly upwardly directly over said pawl.

12. A cabinet drawer latch as claimed in claim 11 wherein said resilient member extends upwardly at an approximate thirty-five degree angle from said pawl.

13. A cabinet drawer latch as claimed in claim 11 wherein said pawl body defines an axle opening.

14. A cabinet drawer latch as claimed in claim 11 wherein said resilient member extends over said axle opening.

15. A cabinet drawer latch as claimed in claim 11 wherein said pawl comprises a pointed end.

* * * * *